US010171927B2

(12) United States Patent
Haurais et al.

(10) Patent No.: US 10,171,927 B2
(45) Date of Patent: Jan. 1, 2019

(54) METHOD FOR PROCESSING AN AUDIO SIGNAL FOR IMPROVED RESTITUTION

(75) Inventors: Jean-Luc Haurais, Paris (FR); Franck Rosset, Brussels (BE)

(73) Assignee: AXD Technologies, LLC, Los Angeles, CA (US)

( * ) Notice: Subject to any disclaimer, the term of this patent is extended or adjusted under 35 U.S.C. 154(b) by 620 days.

(21) Appl. No.: 14/125,674

(22) PCT Filed: Jun. 15, 2012

(86) PCT No.: PCT/FR2012/051345

§ 371 (c)(1),
(2), (4) Date: Mar. 12, 2014

(87) PCT Pub. No.: WO2012/172264

PCT Pub. Date: Dec. 20, 2012

(65) Prior Publication Data

US 2014/0185844 A1 Jul. 3, 2014

(30) Foreign Application Priority Data

Jun. 16, 2011 (FR) ..... 11 01882

(51) Int. Cl.
*H04S 7/00* (2006.01)
*H04S 3/00* (2006.01)
*H04S 3/02* (2006.01)

(52) U.S. Cl.
CPC ..... *H04S 7/30* (2013.01); *H04S 3/004* (2013.01); *H04S 3/02* (2013.01); *H04S 2400/01* (2013.01);

(Continued)

(58) Field of Classification Search
None
See application file for complete search history.

(56) References Cited

U.S. PATENT DOCUMENTS 7,024,259 B1 * 4/2006 Sporer ..... H04S 7/30 381/303
2004/0111171 A1 * 6/2004 Jang ..... H04S 7/30 700/94

(Continued)

FOREIGN PATENT DOCUMENTS

GB 2471089 A 12/2010
WO 9725834 A2 7/1997

(Continued)

OTHER PUBLICATIONS

Zotkin et al, "Rendering localized spatial audio in a virtual auditory space." Aug. 2004. pp. 1-12.*

(Continued)

*Primary Examiner* — Curtis Kuntz
*Assistant Examiner* — Qin Zhu
(74) *Attorney, Agent, or Firm* — Knobbe, Martens, Olson & Bear, LLP

(57) ABSTRACT

A method comprises multichannel processing of an input audio signal by a multichannel convolution with a predefined imprint, the imprint being formulated by the capture of a reference sound by a set of speakers disposed in a reference space. The method further comprises selecting at least one imprint from among a plurality of imprints previously formulated in different sound contexts.

7 Claims, 3 Drawing Sheets

(52) U.S. Cl.
CPC ..... *H04S 2400/03* (2013.01); *H04S 2400/05* (2013.01); *H04S 2400/11* (2013.01); *H04S 2420/01* (2013.01)

(56) References Cited

U.S. PATENT DOCUMENTS

2004/0264704 A1* 12/2004 Huin ..... H04S 7/301 381/59
2008/0165975 A1* 7/2008 Oh ..... G10L 19/008 381/17
2009/0208022 A1 8/2009 Fukui et al.
2009/0252356 A1 10/2009 Goodwin et al.
2010/0080396 A1* 4/2010 Aoyagi ..... H04S 1/005 381/17
2010/0296678 A1* 11/2010 Kuhn-Rahloff ..... H04S 7/30 381/303
2010/0305725 A1* 12/2010 Brannmark ..... H04S 7/301 700/94
2011/0135098 A1* 6/2011 Kuhr ..... H04S 3/004 381/309
2011/0170721 A1* 7/2011 Dickins ..... H04S 7/306 381/309
2012/0101609 A1 4/2012 Supper et al.
2012/0201405 A1* 8/2012 Slamka ..... H04S 7/306 381/307
2014/0328505 A1* 11/2014 Heinemann ..... H04S 7/303 381/303

FOREIGN PATENT DOCUMENTS

WO 9914983 A1 3/1999
WO 2006024850 A2 3/2006
WO 2007096808 A1 8/2007

OTHER PUBLICATIONS

Kraemer, Alan "Two speakers are better than 5.1." pp. 1-5. May 1, 2001.*
Kayser et al, "Database of multichannel in-ear and behind-the-ear head-related and binaural room impulse responses." pp. 1-10. 2009.*
Henrik Moller; Fundamentals of Binaural Technology; Applied Acoustics, Elsevier Science Publishing, GB, vol. 36, No. 3-4, Jan. 1, 1992, XP009112086, ISSN: 0003-682X, DOI: 10.1016/0003-682X(92)90046-U; pp. 171-218.

* cited by examiner

METHOD FOR PROCESSING AN AUDIO SIGNAL FOR IMPROVED RESTITUTION

BACKGROUND

Field of the Invention

The present invention concerns the field of audio signal processing with a view to the creation of improved acoustic ambience, in particular for listening with headphones.

Prior Art

The international patent application WO/2006/024850 describing a method and system for virtualising the restitution of an audible sequence, is known from the prior art. According to this known solution, a listener can listen to the sound of virtual loudspeakers by means of headphones with a level of realism that is difficult to distinguish from that of real loudspeakers. Sets of personalised spatial pulse responses (PSPRs) are acquired for the audible sources of the loudspeakers by means of a limited number of positions of the head of the listener. The personalised spatial pulse responses are used to transform an audio signal intended for the loudspeakers into a virtualised output for the headphones. By basing the transformation on the position of the head of the listener, the system can adjust the transformation so that the virtual loudspeakers appear not to move when the listener moves his head.

Drawback of the Prior Art

The solution proposed in the prior art is not particularly satisfactory since it does not make it possible to personalise the reference sound ambience, not to modify type of sound ambience with respect to a type of sequence to be restored.

Moreover, the solution of the prior art results in a significant duration of the capture of the sound imprint using expensive computer processing operations requiring large computing resources. In addition, this known solution does not make it possible to break a stereo signal down into N channels and does not provide for the generation of channels that do not exist at the start.

SUMMARY

The present invention aims to afford a solution to this problem. In particular the method that is the subject matter of the invention makes it possible to transform 2D sound into 3D sound either using a stereo file or using multichannel files, to generate a 3D audio stereo by virtualisation, with the possibility of choosing a particular sound context.

To this end, the invention concerns, according to its most general meaning, a method for processing an original audio signal of N.x channels, N being greater than 1 and x being greater than or equal to 0, comprising a step of multichannel processing of said input audio signal by a multichannel convolution with a predefined imprint, said imprint being formulated by the capture of a reference sound by a set of speakers disposed in a reference space, characterised in that it comprises an additional step of selecting at least one imprint from a plurality of imprints previously formulated in different sound contexts.

This solution, based on a frequency filtering, differential between left channel and right channel in order to form a centre channel, and a differentiation of phases, makes it possible to create, from a stereo signal, a multitude of stereo channels where each virtual speaker is a stereo file.

It makes it possible to apply a different imprint to each of the virtual channels and to create a new final stereo audio file by recombination of the channels keeping the 3D imprint of each virtual speaker.

Advantageously, the method according to the invention comprises a step of creating a new imprint by processing at least one previously formulated imprint.

According to a variant, the method further comprises a step of recombining the N.x channels thus processed in order to produce an output signal of M.y channels, with N.x different from M.y, M being greater than 1 and y greater than or equal to 0.

DETAILED DESCRIPTION

Figure 1:
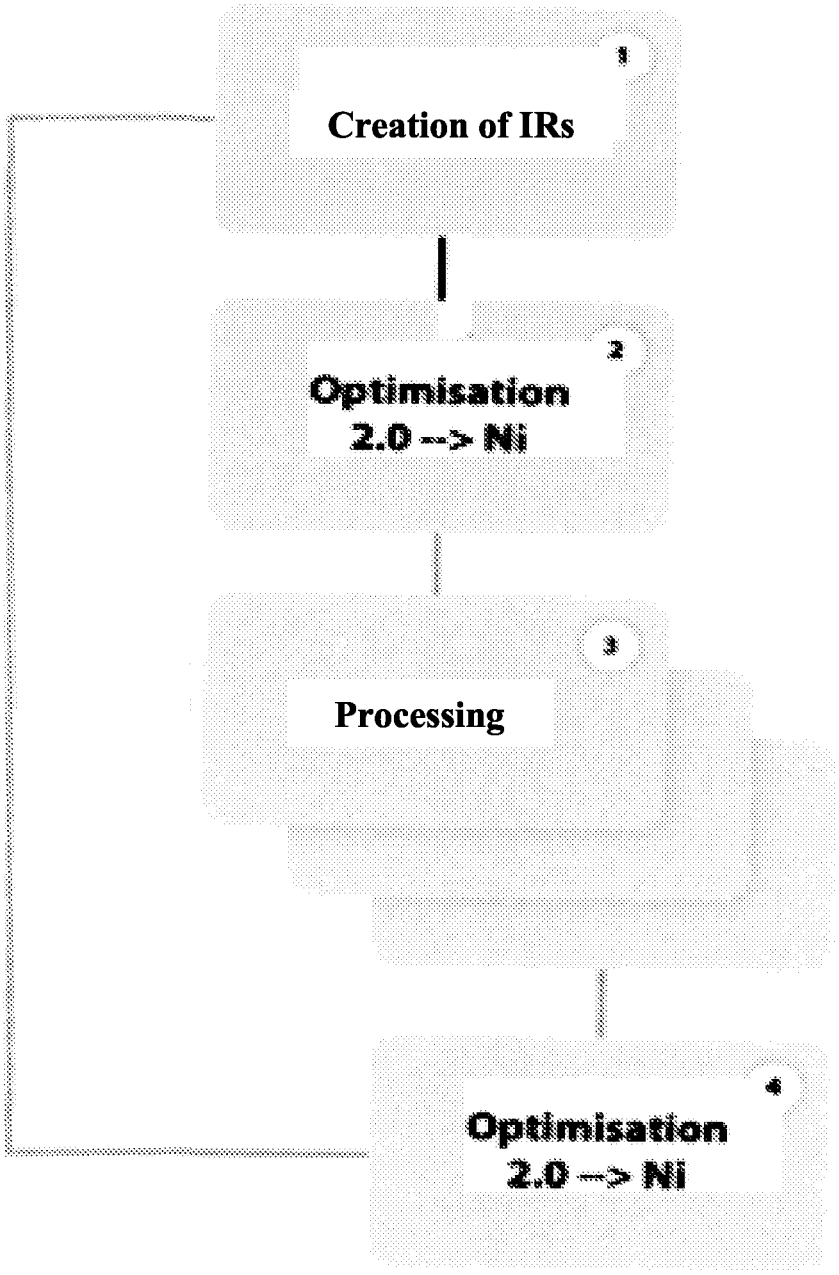
FIG. 1 is a process diagram of the exemplary process of processing an original audio signal.
Figure 2:
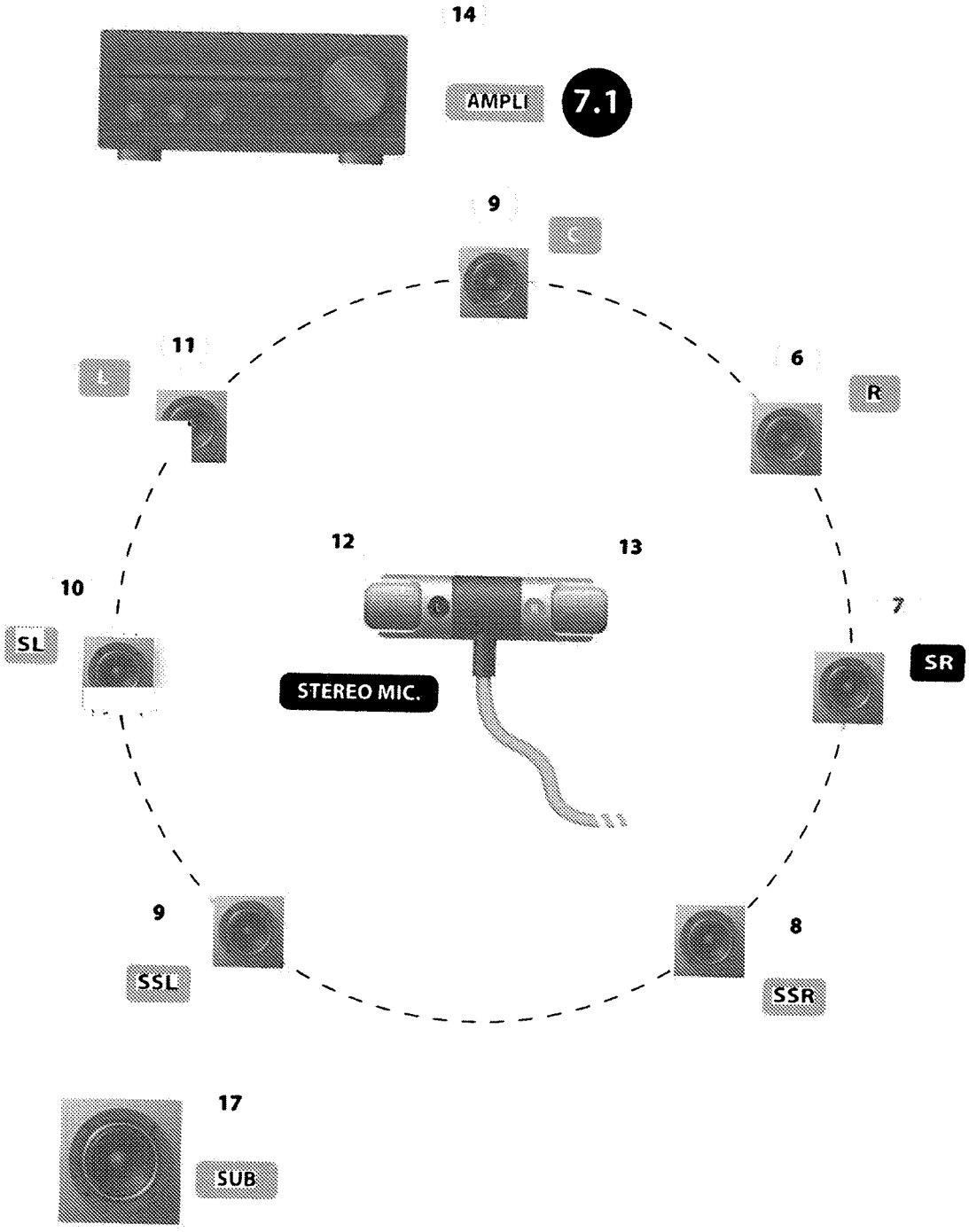
FIG. 2 is a diagram of the arrangement of equipment for the exemplary method of creating sound imprints.
Figure 3:
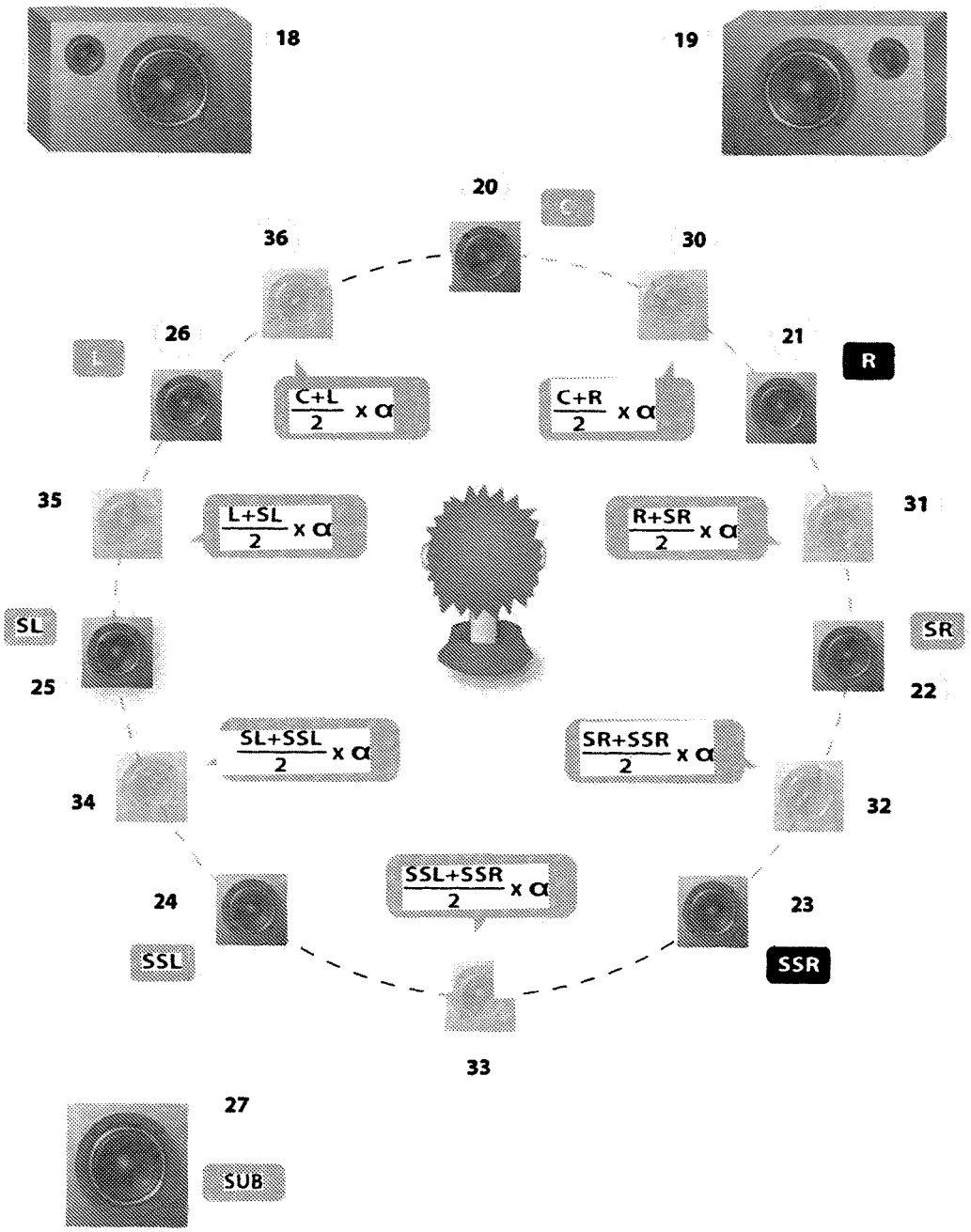
FIG. 3 is a diagram for the distribution of an exemplary created virtualized imprint.

The invention will be described hereinafter non-limitatively.

The method according to the invention is broken down into a succession of steps:

- creation of several series of sound imprints
- creation of a series of virtualised imprints by combination of a library of imprints
- association of the tracks of the original sound signal with a series of virtualised imprints.

1—Creation of the Imprint

Acquisition of the Signal

The creation of a sound imprint consists of disposing, in a defined environment, for example a concert auditorium, a hall, or even a natural space (a cave, an open space, etc), a set of acoustic imprints organised in N×M sound points. For example a simple pair of "right-left" speakers, or a set 5.1, or 7.1 or 11.1 of speakers restoring a reference sound signal in a known manner.

A pair of microphones is disposed, for example an artificial head, or HRTF multidirectional capture microphones, capturing the restitution of the speakers in the environment in question. The signals produced by the pair of microphones are recorded after sampling at a high frequency, for example 192 kHz, 24 bits.

This digital recording makes it possible to capture a signal representing a given sound environment.

This step is not limited to the capture of a sound signal produced by speakers. The capture may also be made from a signal produced by headphones, placed on an artificial head. This variant will make it possible to recreate the sound ambience of given headphones, at the time of restitution on another set of headphones.

2—Calculation of the Imprint

This signal is then subjected to processing consisting of applying a differential between the reference signal applied to the speakers, digitised under the same conditions, and the signal captured by the microphones. This differential is formulated by a computer receiving as an input the .vaw or audio files respectively of the reference signal applied to each of the speakers on the one hand and the captured signal on the other hand, in order to produce a signal of the "IR—Impulse response" type for each of the speakers that was used to generate the reference signal. This processing is applied to each of the input signals of each of the speakers captured.

This processing is applied to each of the input signals of each of the speakers captured.

This processing produces a set of files, each corresponding to the imprint of one of the speakers in the defined environment.

Formulation of a Family of Imprints

The aforementioned step is reproduced for various sound environments and/or various speaker layouts. For each of the new arrangements, an acquisition and then processing step is performed in order to produce a new series of imprints representing the new sound alignment.

In this way a library of series of sound imprints representing the given known sound environments is constructed.

Creation of a Virtual Environment

The aforementioned library is used to produce a new series of imprints, representing a virtual environment, by combining several series of imprints and adding files corresponding to the selected imprints so as to reduce the areas where the sound environment was devoid of speakers during the aforementioned acquisition step.

This step of creating a virtual environment makes it possible to improve the coherence and dynamic range of the sound resulting from the application to a given recording, in particular by a better three-dimensional occupation of the sound space.

This amounts to using a simulated environment of a very large number of speakers.

The result of this step is a new virtualised hall imprint, which can be applied to any sound sequence, in order to improve the rendition.

Processing of a Sound Sequence

A known audio sequence is then chosen, sampled to the same preference conditions.

Failing this, the virtualised imprint is adapted so as to reduce the frequency and the sampling to those of the audio signal to be processed.

The known signal is for example a stereo signal. It is the subject of frequency chopping and a chopping based the phase difference between the right signal and the left signal.

From this signal, N tracks are extracted by applying one of the virtualised imprints to combinations of these choppings.

It is thus possible to produce a variable number of tracks, by combining the result of the choppings, and applying one of the imprints to each of the tracks, in order to create N×M tracks, N and M not necessarily being the number of channels used during the imprint creation step. It is possible for example to generate a larger number of tracks, for more dynamic restitution, or a smaller number, for example for restitution by headphones.

The result of this step is a succession of audio signals that are then transformed into a conventional stereo signal in order to be compatible with restitution on standard equipment.

Naturally, it is possible also to apply processing operations such as signal phase rotations.

The step of processing a sound sequence can be performed in deferred mode, in order to produce recordings that can be broadcast at any moment.

It can also be performed in real time so as to process an audio stream at the time it is produced. This variant is particularly suited to the real-time transformation of a sound acquired in streaming into an enriched audio sound for restitution with a better dynamic range.

According to a variant use, the processing makes it possible to produce a signal producing a lifting of any doubt about a central sound signal, which the human brain may "imagine" by error at the rear whereas it is a signal at the front. For this purpose, a horizontal movement is performed to enable the brain to be readjusted, and then a re-centring. This step consists of slightly increasing the level or presence of a centre front virtual speaker.

This step is applied whenever the audio signal is mainly centred, which is often the case for the "voice" part of a musical recording. This presence-increase processing is applied transiently, preferably when a centred audio sequence appears.

The invention claimed is:

1. A method for processing an audio signal of N.x channels, N being greater than 1 and x being greater than or equal to 0, comprising:

processing the audio signal by a multichannel convolution with a predefined imprint, the predefined imprint being formulated at least by the capture of a reference sound by a set of speakers disposed in a reference space, wherein the method further comprises:

selecting two or more imprints from a plurality of imprints previously formulated in a plurality of different sound contexts; and combining the selected imprints formulated in different sound contexts to create a new imprint representing a virtual environment.

2. The method according to claim 1, further comprising adding files corresponding to the selected imprints formulated in different sound contexts to create the new imprint.

3. The method according to claim 1, further comprising recombining the N.x channels thus processed in order to produce an output signal of M.y channels, with N.x different from M.y, M being greater than 1 and y greater than or equal to 0.

4. The method according to claim 1, further comprising transiently increasing the level of presence of a center front virtual speaker when the audio signal is centered.

5. The method according to claim 2, further comprising recombining the N.x channels thus processed in order to produce an output signal of M.y channels, with N.x different from M.y, M being greater than 1 and y greater than or equal to 0.

6. The method according to claim 2, further comprising transiently increasing the level of presence of a center front virtual speaker when the audio signal is centered.

7. The method according to claim 1, further comprising creating a plurality of new files by adding files corresponding to two or more of the plurality of imprints previously formulated in the plurality of different sound contexts with a phrase shift.

* * * * *